United States Patent [19]

Ogata et al.

[11] Patent Number: 4,542,077

[45] Date of Patent: Sep. 17, 1985

[54] TIN-FREE STEEL SHEETS HAVING IMPROVED LACQUER ADHESION

[75] Inventors: Hajime Ogata; Yoshiharu Ohashi; Shunichi Tsugawa; Toshio Ichida; Toshio Irie, all of Chiba, Japan

[73] Assignee: Kawasaki Steel Corporation, Kobe, Japan

[21] Appl. No.: 641,943

[22] PCT Filed: Jan. 27, 1984

[86] PCT No.: PCT/JP84/00021

§ 371 Date: Aug. 2, 1984

§ 102(e) Date: Aug. 2, 1984

[87] PCT Pub. No.: WO84/02931

PCT Pub. Date: Aug. 2, 1984

[30] Foreign Application Priority Data

Jan. 28, 1983 [JP] Japan ..... 58-13047

[51] Int. Cl.[4] ..... C25D 11/38; C25D 3/04

[52] U.S. Cl. ..... 428/629; 148/6.16; 148/31.5; 204/14.1; 428/632; 428/935

[58] Field of Search ..... 428/629, 632; 148/31.5

[56] References Cited

U.S. PATENT DOCUMENTS

| | | | |
|---|---|---|---|
| 3,826,628 | 6/1974 | Addinall et al. | 428/629 |
| 4,296,182 | 10/1981 | Matsubayashi et al. | 428/629 |
| 4,455,355 | 6/1984 | Inui et al. | 428/629 |

FOREIGN PATENT DOCUMENTS

| | | |
|---|---|---|
| 55-58395 | 5/1980 | Japan . |
| 55-158295 | 12/1980 | Japan . |
| 58-110695 | 7/1983 | Japan . |

*Primary Examiner*—Veronica O'Keefe

*Attorney, Agent, or Firm*—Young & Thompson

[57] ABSTRACT

This invention provides a tin-free steel sheet, having superior lacquer adhesion, comprising metallic chromium and chromium oxide coatings on a steel sheet, characterized in that the chromium oxide coating is controlled such that $I_{Cr}^{580}/(I_{Cr}^{580}+I_{Cr}^{660})$ has a value of 0.5 or more provided that $I_{Cr}^{580}$ is the percent transmission corresponding to ol linkage and $I_{Cr}^{660}$ is the percent transmission corresponding to oxo linkage in the infrared absorption spectrum of said chromium oxide coating as measured by Fourier transform infrared spectroscopy.

1 Claim, 7 Drawing Figures

TIN-FREE STEEL SHEETS HAVING IMPROVED LACQUER ADHESION

TECHNICAL FIELD

This invention relates to tin-free steel sheets having improved lacquer adhesion.

TECHNICAL BACKGROUND

Surface treated steel sheets having double coatings, metallic chromium and chromium oxide coatings are designated tin-free steel of chromium type (to be simply referred to as TFS, hereinafter). TFS is regarded as a substitute for tin plates because of its improved properties as can-forming material, and the demand for TFS is increasing in these years. Since TFS has metallic chromium and chromium oxide coatings on the surface, it does not possess sufficient weldability. In manufacturing cans from TFS, a can barrel is formed by applying an epoxy-phenol resin to a blank and bonding the blank with a nylon adhesive.

Recently, the extent of application of TFS cans has been further spread. That is, TFS cans are not only used for so-called cold packs prepared by filling cans with contents such as carbonated beverage and beer at low temperatures, but also used for so-called hot packs prepared by filling cans with contents such as fruit juice and coffee at high temperatures for sterilization as well as retort packs requiring a high temperature retorting treatment for sterilization at the end of packing. In the latter applications, there often occurred accidents of rupture of can barrels.

This can barrel rupture occurs in bonded TFS cans during hot packing and retorting treatment because hot water penetrates through the lacquer film at the barrel junction to deteriorate the interfacial adhesion between the lacquer film and the TFS sheet to eventually separate the lacquer film from the TFS sheet. Extensive investigations have been made to develop TFS sheets which are not susceptible to deterioration of the adhesion between the lacquer film and the TFS sheet.

DISCLOSURE OF THE INVENTION

Particularly, the inventors have made investigations how lacquer adhesion varies in relation to the structure of the TFS surface coating to find that lacquer adhesion is closely correlated to the degree of olation of the chromium oxide coating as analyzed by Fourier transform infrared spectroscopy (to be simply referred to as FIIR, hereinafter), and the present invention is based on this discovery.

According to the present invention, there is provided a tin-free steel sheet having metallic chromium and chromium oxide layers on a steel sheet, characterized in that for improved lacquer adhesion, $I_{Cr}^{580}/(I_{Cr}^{580}+I_{Cr}^{660})$ has a value of 0.5 or more provided that $I_{Cr}^{580}$ is the percent transmission corresponding to ol linkage and $I_{Cr}^{660}$ is the percent transmission corresponding to oxo linkage in the infrared absorption spectrum of said chromium oxide layer as measured by Fourier transform infrared spectroscopy (FIIR).

DETAILED DESCRIPTION OF THE INVENTION

The present invention is directed to TFS sheets having a metallic chromium coating (to be referred to as $Cr^{M}$ coating) deposited to 50 to 200 $mg/m^2$ and a chromium oxide coating (to be referred to as $Cr^{OX}$ coating, hereinafter) deposited to 10 to 30 $mg/m^2$ of metallic chromium on each surface of a cold-rolled steel sheet. TFS usually has a $Cr^{M}$ layer deposited to 50 to 200 $mg/m^2$ because corrosion resistance is poor for $Cr^{M}$ layers of less than 50 $mg/m^2$ while no further improvement in corrosion resistance is expectable for $Cr^{M}$ layers exceeding 200 $mg/m^2$. On the other hand, the desired lacquer adhesion is not achievable with $Cr^{OX}$ layers of less than 10 $mg/m^2$, while $Cr^{OX}$ layers exceeding 30 $mg/m^2$ appear poor, losing commercial acceptance.

The adhesion of lacquer to TFS is very important because TFS is generally coated with an epoxy-phenol lacquer prior to use. Presuming that it is the structure of the $Cr^{OX}$ coating that controls the lacquer adhesion the inventors continued research works.

There were found many reports which used electron spectroscopy for chemical analysis (ESCA) and Auger electron spectroscopy (AES) as measures for structural analysis of $Cr^{OX}$ coatings. The inventors also made initial research works using these analytical techniques, but failed to get as good results as needed by the inventors themselves. The $Cr^{OX}$ coating has a giant molecule structure composed essentially of Cr—OH linkages (ol-linkages) and Cr—O linkages (oxo-linkages), in which many molecules of $H_2O$ (bound water) or anions such as $SO_4^{2-}$, $F^-$, etc. are contained. Direct analysis of spectra obtained by ESCA and AES cannot distinguish those O elements assigned to Cr—OH linkage, Cr—O linkage, $H_2O$, and the like from each other.

Figure 1:
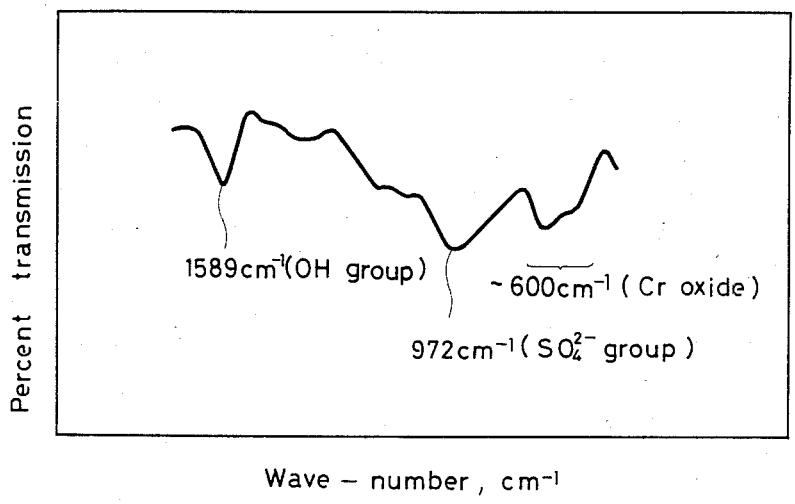
FIG. 1 is a chart of the infrared absorption spectrum of a $Cr^{OX}$ coating on a TFS sheet as measured by FTIR.
Figure 2:
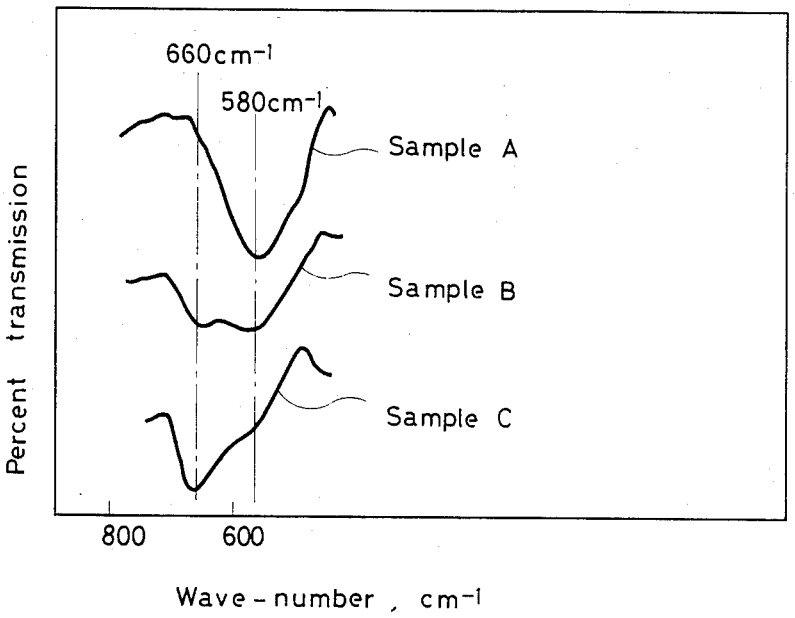
FIG. 2 is an enlarged chart illustrating the infrared absorption spectra near 600 $cm^{-1}$ of the surface of TFS sample A having superior lacquer adhesion, sample B having intermediate lacquer adhesion, and sample C having inferior lacquer adhesion.

Then, the inventors intended to apply the infrared spectroscopy sensitive to atomic bond structures to the analysis of the $Cr^{OX}$ coating structure. As ordinary dispersive infrared spectrometers are less sensitive for the measurement of the coating surface vicinity, Fourier transform infrared spectroscopy (FTIR) is employed herein. FIG. 1 is an exemplary infrared absorption spectrum of a $Cr^{OX}$ coating on TFS as measured by FTIR. Peaks at 1589 $cm^{-1}$, at 972 $cm^{-1}$, and near 600 $cm^{-1}$ are assigned to OH group, $SO_4^{2-}$ group, and chromium oxide, respectively. The inventors have found that the profile near 600 $cm^{1}$ has a significant influence on the adhesion of lacquer to TFS. FIG. 2 illustrates in an enlarged fashion those portions near 600 $cm^{-1}$ of the superficial infrared absorption spectra of a TFS sheet having superior lacquer adhesion (Sample A), a TFS sheet having intermediate lacquer adhesion (Sample B), and a TFS sheet having inferior lacquer adhesion (Sample C). A deep absorption peak is found at 580 $cm^{-1}$ for Sample A, absorption peaks at 580 $cm^{-1}$ and 660 $cm^{-1}$ are of substantially the same intensity for Sample B, and a deeper absorption peak appears at 660 $cm^{-1}$ and the absorption peak at 580 $cm^{-1}$ becomes more vague for Sample C.

Figure 3:
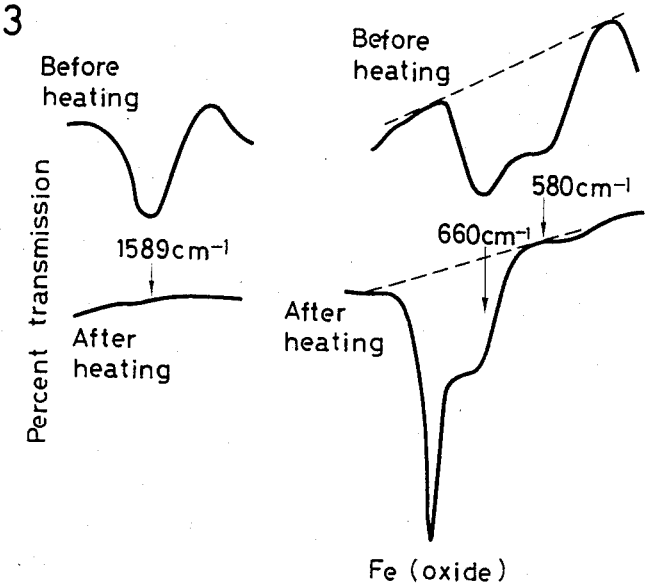
FIG. 3 illustrates the infrared absorption spectra of TFS before and after heating for analysis of $Cr^{OX}$ coating structure.

In order to determine the linkages in the $Cr^{OX}$ coating structure to which the absorption peaks appearing at 580 $cm^{-1}$ and 660 $cm^{-1}$ are assigned, the following experiment was carried out. A TFS sample was heated at 700° C. for removal of water, and the infrared absorption spectrum of the sample was measured before and after heating for comparison (see FIG. 3). The absorption peak at 1580 $cm^{-1}$ assigned to OH group completely disappeared after the heat treatment, and at the same time, the absorption peak at 580 $cm^{-1}$ disappeared and the absorption peak at 660 $cm^{-1}$ became more intense. When the fact that $Cr(OH)_3$ is completely converted to $Cr_2O_3$ through the heat treatment at 700° C. is taken into account, it is presumed that the absorption peaks appearing at 580 $cm^{-1}$ and 660 $cm^{-1}$ are assigned to Cr—OH linkage (ol-linkage) and Cr—O linkage (oxo-linkage), respectively. As evident from this result, FIG. 2 indicates that more oxo-linkages and less ol-linkages are present in the $Cr^{OX}$ coating of TFS having inferior lacquer adhesion whereas more ol-linkages and less oxo-linkages are present in the $Cr^{OX}$ coating of TFS having superior lacquer adhesion.

In order to quantitatively describe these results of analysis of the $Cr^{OX}$ coating structure on TFS, the inventors has set up degree of olation. That is, it is presumed that in the infrared absorption spectrum of the coating as measured by FTIR, the proportion of ol-linkages present in the $Cr^{OX}$ coating is expressed by $I_{Cr}^{580}/(I_{Cr}^{580}+I_{Cr}^{660})$ provided that $I_{Cr}^{580}$ and $I_{Cr}^{660}$ represent percent transmissions at 580 $cm^{-1}$ and 660 $cm^{-1}$ in the infrared absorption spectrum as measured on the TFS surface by FTIR, and this ratio is defined as degree of olation.

Figure 4:
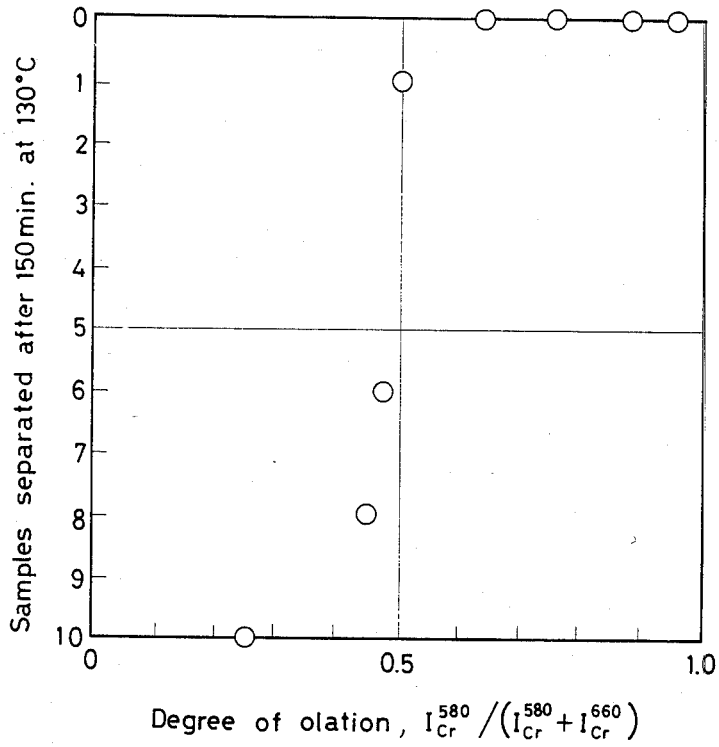
FIG. 4 is a diagram illustrating lacquer adhesion in relation to degree of olation.

The adhesion of lacquer to TFS was determined in relation to the degree of olation as defined above, with the results shown in FIG. 4. Lacquer adhesion is poor in those TFS sheets having $Cr^{OX}$ coatings with a low degree of olation while lacquer adhesion is good in those TFS sheets having $Cr^{OX}$ coatings with a high degree of olation. It was found that lacquer adhesion is greatly improved particularly when the $Cr^{OX}$ coating has a degree of olation of 0.5 or more. This correlation of lacquer adhesion to degree of olation is explained as follows. The adhesive force between a lacquer film (OH group-containing epoxy-phenol resin) and a TFS sheet is attributable to the bond formed between OH groups in the lacquer film and Cr—OH linkages in the $Cr^{OX}$ coating (neither $H_2O$ nor Cr—O linkages are pertinent). Since more OH groups (resulting from Cr—OH linkages) are present on the surface of a TFS sheet having a $Cr^{OX}$ coating with a higher degree of olation, they form more bonds with OH groups in the lacquer film. For this reason TFS sheets having a higher degree of olation show improved lacquer adhesion thereto. The bonds between OH groups in the lacquer film and OH groups in the $Cr^{OX}$ coating may include simple hydrogen bonds and bonds resulting from certain reactions between such OH groups (for example, dehydration-condensation reaction), but the exact mechanism is unclear.

Figure 5:
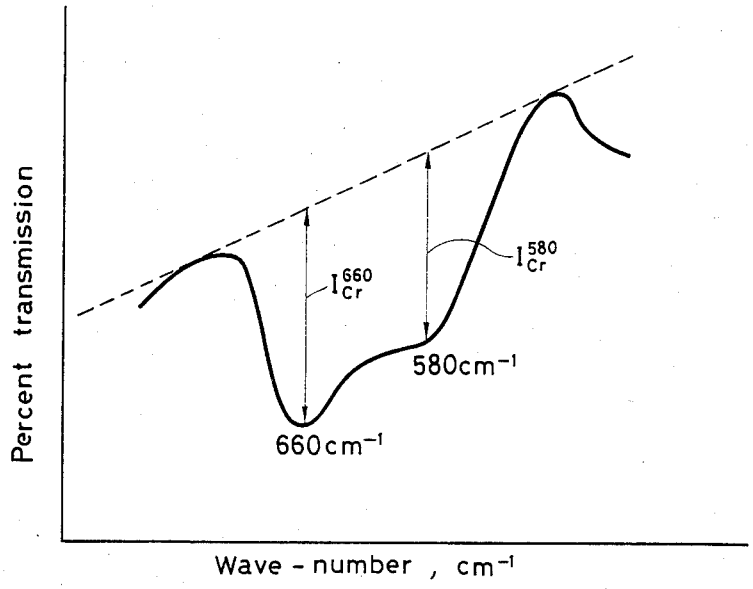
FIG. 5 illustrates how to determine the intensity of transmission in an infrared absorption spectrum as measured by FTIR.

The FTIR spectrometer used in the present invention is FTIR model JIR 100 manufactured by Nihon Electronics K.K. and the measurement conditions are: resolving power 8 $cm^{-1}$, reflection angle 75 degrees, and integration number 200 times, with the reference being tin plate (T4CA). Measurement direction was fixed to the L direction, that is, the rolling direction of steel sheets. Of course, the measurement direction is not limited to the L direction because directional difference is eliminated by converting measurements to an intensity ratio like degree of olation. The only reason why measurement was made in the fixed L direction of steel sheets in the present invention is that the intensity itself varies with measurement direction. Intensity value given as $I_{Cr}^{580}$ and $I_{Cr}^{660}$ are calculated by drawing a base line in a chart plotted for percent transmission as shown in FIG. 5.

Figure 6A:
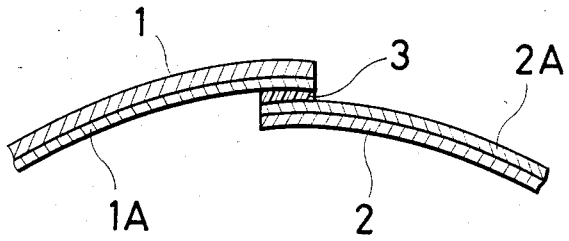
FIGS. 6*a* & *b* illustrate how to evaluate the adhesion of lacquer to TFS sheets.
Figure 6B:
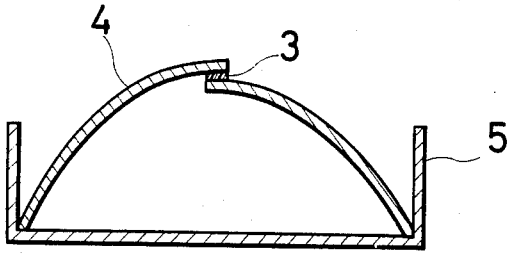

The lacquer adhesion to steel sheets was evaluated as follows. Referring to FIG. 6*a*, a phenol-epoxy lacquer was applied to the surface of a steel sheet 1 to a build-up of 60 $mg/m^2$ and baked at 210° C. for 12 minutes to form a thick film 1A. The same lacquer was applied to the surface of another sheet 2 to a build-up of 25 $mg/m^2$ and baked under the same conditions as above to form a thin film 2A. These two sheets were cut to pieces of 70 mm wide by 60 mm long, and the longitudinal end portions of the two pieces having lacquer films of different thicknesses were overlapped a distance of 8 mm with a nylon film 3 of 100 μm thick interposed therebetween. Using a hot press, the overlapped pieces were pre-heated to 200° C. for 120 seconds and press bonded under a pressure of 3 $kg/cm^2$ at 200° C. for 30 seconds. Ten samples 4 were prepared in each example, mounted in a jig 5 as shown in FIG. 6*b*, and placed in a retort kettle at 130° C. to determine the number of separated samples after 150 and 300 minutes. Evaluation was made according to the following criterion in Examples and Comparative Examples. Samples marked with a circle "O" were judged superior in paint adhesion.

O:
0–1 sample separated after 150 min., and
0–5 samples separated after 300 min.

X:
0–1 sample separated after 150 min., and
6 or more samples separated after 300 min.

X:
2 or more samples separated after 150 min.

BEST MODE FOR CARRYING OUT THE INVENTION

The following examples and comparative examples are given to further illustrate the present invention.

Cold rolled steel sheets (T4CA) having a thickness of 0.22 mm were electrolytically degreased in 5% homezarine at 80° C. at a current density of 5 $A/dm^2$, rinsed with water, pickled by immersing them in 10% $H_2SO_4$ for 5 seconds, rinsed with water, and then subjected to electroplating treatments as described below such that the built-ups of $Cr^M$ and $Cr^{OX}$ might fall in the ranges of 50–200 $mg/m^2$ and 10–30 $mg/m^2$, respectively.

Example 1

In an electrolytic solution containing 150 grams of $CrO_3$, 5 grams of $Na_2SiF_6$, 0.8 grams of $H_2SO_4$, and 2 grams of $Cr^{3+}$ per liter of the solution at 50° C., a steel sheet was first made the cathode and subjected to a chromium electroplating treatment at 50 $A/dm^2$ for 1.5 seconds, and the sheet was then made the anode and subjected to a reverse electrolytic treatment in the same solution at 5 $A/dm^2$ for 0.2 seconds. After rinsing with water, the treated steel sheet was made the cathode and subjected to an electrolytic chromate treatment in an electrolytic solution containing 50 grams of $CrO_3$ and 0.05 grams of $H_2SO_4$ per liter of the solution at 40° C. at 15 A/dm$^2$ for 3 seconds. Water rinsing and drying resulted in a TFS sheet.

Comparative Example 1

A TFS sheet was manufactured by the same procedure as used in Example 1 except that the reverse electrolytic treatment was omitted and the conditions for the electrolytic chromate treatment were changed to 15 A/dm$^2$ for 1 second in order to adjust the build-up of $Cr^{OX}$ to 10 to 30 mg/m$^2$.

Example 2

In an electrolytic solution containing 90 grams of $CrO_3$, 0.1 grams of $H_2SO_4$, and 2.0 grams of $HBF_4$ per liter of the solution at 55° C., a steel sheet was made the cathode and electrolyzed at 60 A/dm$^2$ for 1 second, and then dried.

Example 3

In an electrolytic solution containing 80 grams of $CrO_3$, 4 grams of $Na_2SiF_6$, and 1 gram of NaF per liter of the solution at 50° C., a steel sheet was made the cathode and electrolyzed at 40 A/dm$^2$ for 1.5 seconds, and then dried.

Comparative Example 2

In an electrolytic solution containing 50 grams of $CrO_3$, 2 grams of NaF, and 0.005 grams of $H_2SO_4$ per liter of the solution at 45° C., a steel sheet was made the cathode and electrolyzed at 30 A/dm$^2$ for 2 seconds, and then rinsed with water and dried.

The results of the adhesion of lacquer to the TFS sheets manufactured in Examples 1–3 and Comparative Examples 1–2 are shown in Table 1 along with the degree of olation of the corresponding $Cr^{OX}$ coatings as measured by FTIR. As seen from Table 1, the sheets of Examples 1–3 having $Cr^{OX}$ coatings with a degree of olation of more than 0.5 exhibit superior lacquer adhesion whereas the sheets of Comparative Examples 1–2 having $Cr^{OX}$ coatings with a degree of olation of less than 0.5 exhibit inferior lacquer adhesion.

TABLE 1

| | Degree of olation | Samples separated after 150 min. at 130° C. | Samples separated after 300 min. at 130° C. | Lacquer adhesion |
|---|---|---|---|---|
| Example 1 | 0.80 | 0 | 0 | O |
| Example 2 | 0.69 | 0 | 2 | O |
| Example 3 | 0.54 | 1 | 4 | O |
| Comparative Example 1 | 0.25 | 10 | — | X |
| Comparative Example 2 | 0.45 | 6 | 8 | X |

What is claimed is:

1. A tin-free steel sheet having metallic chromium and chromium oxide coatings on a steel sheet, characterized in that for improved lacquer adhesion, $I_{Cr}^{580}/(I_{Cr}^{580}+I_{Cr}^{660})$ has a value of 0.5 or more provided that $I_{Cr}^{580}$ is the percent transmission corresponding to ol linkage and $I_{Cr}^{660}$ is the percent transmission corresponding to oxo linkage in the infrared absorption spectrum of said chromium oxide coating as measured by Fourier transform infra-red spectroscopy (FTIR).

* * * * *